United States Patent [19]

Kanemitsu et al.

[11] Patent Number: 4,551,000

[45] Date of Patent: Nov. 5, 1985

[54] PROCESS KIT AND AN IMAGE FORMING APPARATUS USING THE SAME

[75] Inventors: Shinji Kanemitsu, Ichikawa; Shigeyoshi Onoda, Kawasaki; Fumio Nishino, Tokyo; Akihiro Nomura; Morikazu Mizutani, both of Kawasaki; Hiroshi Nitanda, Tokyo, all of Japan

[73] Assignee: Canon Kabushiki Kaisha, Tokyo, Japan

[21] Appl. No.: 360,686

[22] Filed: Mar. 22, 1982

[30] Foreign Application Priority Data

Apr. 1, 1981 [JP] Japan ..... 56-48915

[51] Int. Cl.[4] ..... G03G 15/00

[52] U.S. Cl. ..... 355/3 R; 355/3 DR

[58] Field of Search ..... 355/3 R, 3 DR, 14 R, 355/14 CU; 354/275, 276, 468

[56] References Cited

U.S. PATENT DOCUMENTS

| | | | |
|---|---|---|---|
| 3,600,086 | 8/1971 | Cates et al. | 355/16 |
| 3,756,711 | 9/1973 | Limberger | 355/14 CU X |
| 3,872,282 | 3/1975 | Long | 355/14 CU X |
| 3,886,329 | 5/1975 | Kamiyama | 355/14 CU X |
| 3,900,740 | 8/1975 | Akimoto et al. | 355/14 R X |
| 3,926,515 | 12/1975 | Nagahara | 355/3 R |
| 3,985,436 | 10/1976 | Tanaka et al. | 355/8 |
| 4,084,901 | 4/1978 | Aasen et al. | 355/3 R X |
| 4,239,365 | 12/1980 | Norris | 354/275 X |
| 4,386,838 | 7/1983 | Hirabayashi et al. | 355/3 DR |

*Primary Examiner*—A. T. Grimley
*Assistant Examiner*—J. Pendegrass
*Attorney, Agent, or Firm*—Fitzpatrick, Cella, Harper & Scinto

[57] ABSTRACT

A process kit containing consumable members is detachably mountable in the main body of an operating device and includes apparatus for indicating when the useful life of the process kit is about to expire and when it has expired.

21 Claims, 11 Drawing Figures

PROCESS KIT AND AN IMAGE FORMING APPARATUS USING THE SAME

BACKGROUND OF THE INVENTION

1. Field of the Invention

The present invention relates to a process kit detachably used in a main apparatus such as an image forming apparatus. The present invention relates also to an image forming apparatus employing such process kit. The process kit is formed to contain only an image bearing member or a part or all of an image forming means such as a corona discharger, developing device etc. united together into a unit for an image forming apparatus.

2. Description of the Prior Art

An example of the image forming apparatus to which the present invention relates is an electrocopying apparatus. In extended use of a conventional electrocopying apparatus there is required periodical maintenance service. This service includes many works such as exchange of the image bearing member, that is, a photosensitive medium, supply of developing agent, discharge of wasted toner, cleaning of charged lines, exchange of various consumables and adjustment of the machine. Conventionally these works have been done by an expert service man. In case of large to middle size copying machines there is no difficulty related to such service by expert service men because of the limited number of the machines in market. However, in case of small size copying apparatus, in particular, in the case of the copying apparatus for private use, the number of those machines in market is very large at present. In addition, there is a great difference in the state of use among these copying machines. Therefore, it is expected that in the near future such maintenance service by the service man as mentioned above will become practically impossible to do.

Under the situation, it is very important to render unnecessary the periodical maintenance service by experts in particular for private copying machines of small size.

An idea to solve the problem is that the photosensitive drum and some other members related to the process such as developing device, cleaning device and chargers are united together into an easily exchangeable unit (hereinafter such unit is referred to as process kit). If such process kit is realized, then all of the items of maintenance work which have conventionally been done individually such as exchange of photosensitive drum, supply of consumed developing agent, discharge of wasted toner, cleaning of charged lines and, if necessary, also of developing device contaminated by toner particles etc. will be done all at once in good time when the useful life of the photosensitive drum is over. Exchange of the process kit can be carried out in simple manner by the user himself without any aid of expert service man.

This process kit has another advantage in that many kinds of such process kits may be prepared which have different development characteristics and image reproducibility and among which the user can select a most suitable one for the purpose for which the copying machine is used. In this case, a process kit now in use may be replaced by another process kit according to the purpose of copy even before the useful life of the present process unit is over. Therefore, the frequency of process kit exchange will become relatively high.

Since exchange and supply of consumables in a copying machine, hitherto, have been carried by the service man, the conventional image forming apparatus has been formed to include a counter or the like provided on the main body of the apparatus to know the state of use of the apparatus. However, if such process kits described above are used in the same apparatus while exchanging one for another many times by the user himself, then there will arise a problem in correctly knowing the state of use of every kit. For example, it is difficult to correctly know the number of times of executed image formation employing a process kit by means of the counter provided on the main body side. Therefore, there may occur a case wherein unexpectedly the service life of some consumable members of the process kit comes to an end or the toner or other consumable materials are consumed so that the user can not have sufficient time to prepare a new process kit. In such case, the main apparatus must remain unused until the new process kit is prepared. This means a loss of time.

SUMMARY OF THE INVENTION

Accordingly it is the general object of the invention to provide an effective solution to the above problem.

More specifically, it is an object of the invention to make it possible to correctly indicate the state of use of such exchangeable process kit and to keep the apparatus always in the best condition for use.

To attain the above object according to the present invention, there is provided a process kit containing an image bearing member, such as a photosensitive medium or insulating medium, alone or together with a part or all of the image forming means arranged around the image bearing member and to be detachably mounted in the main body of the apparatus, which process kit is provided with means for measuring the useful life of the kit. The measuring means is operable by interlocking it with the time of use of the kit or the number of times of image formation.

In a preferred embodiment of the invention, the service life measuring mechanism provided on the process kit is connected with a service life display part also provided on the process kit. The display part shows the user the remaining useful life of the kit through an optical opening provided on the main body side. The display part interlocked with the measuring mechanism may be provided not on the process kit but on the main body side.

Examples of the apparatus to which the present invention is applicable include copying machines, facsimile equipment and recording machines.

According to the present invention, the user can foretell the end of useful life of the process kit currently in use. Therefore, there is obtained sufficient time to prepare a new process kit for exchange. Further, if the manufacturer sets a term of gaurantee for the user of the process kit, the content of the display on the display part of the kit will give reliable data of the used service life to both the supplier and the user.

Other and further objects, features and advantages of the invention will appear more fully from the following description of preferred embodiments taken in connection with the accompanying drawings.

DETAILED DESCRIPTION OF PREFERRED EMBODIMENTS

Figure 1:
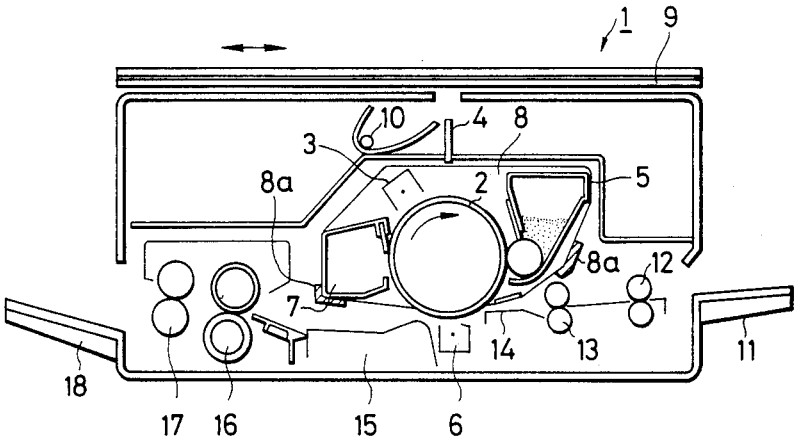
FIG. 1 is a sectional view of the main part of a copying apparatus to which the present invention is related.

FIG. 1 is a sectional view of the essential part of a copying machine in which the present invention is embodied.

The copying machine 1 includes a photosensitive drum 2 disposed at the middle of the machine. The copying machine is of the electrophotography type and the photosensitive member is composed of an electroconductive drum and a photoconductive layer in the manner previously known. Around the photosensitive drum rotatable in the direction of the arrow there are arranged a corona discharger 3, a short focal point optical element array 4, a developing device 5, a transfer corona discharger 6, a cleaning device 7 etc. In the shown embodiment, the photosensitive drum 2, corona discharger 3, developing device 5 and cleaning device 7 are united together into a process kit which is detachable from the main body of the copying machine as a unit. 8 is a frame side plate for supporting and moving these elements of the process kit simultaneously. 8*a* is a guide rail along which the process kit is inserted into the machine body.

Designated by 9 is an original table mounted for reciprocal movement. 10 is a lamp for illuminating the original table. 11 is a guide tray for a supply of transfer material supplied and 12 is a transfer material feeding roller. 13 is a timing roller and 14 is a guide member by which the transfer material is guided to the space between the transfer corona discharger and the photosensitive drum. After transferring, the transfer material is moved toward a fixing device 16 along a guide path 15. 17 is a discharge roller and 18 is a copy tray.

Figure 2:
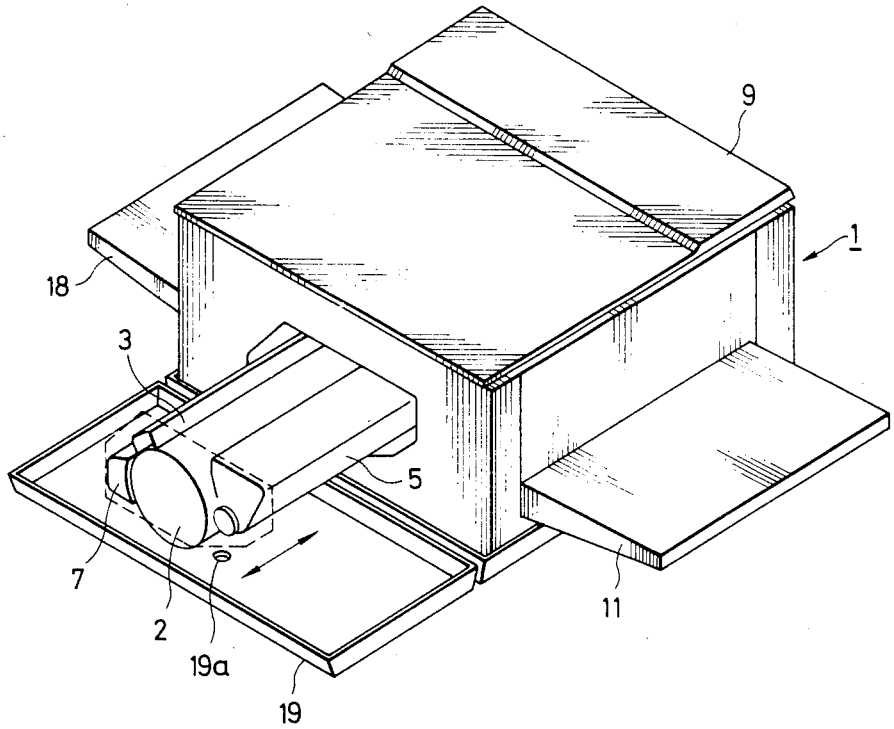
FIG. 2 is a perspective view thereof.

FIG. 2 shows how to remove the process kit from the machine body. In this figure, the kit is shown with its casing being removed. To detach the process kit from the main machine body, one opens a front cover member 19 and draws the kit out of the machine body as shown in FIG. 2. Mounting of the process kit into the machine body can be carried out in a similar manner as suggested by the double arrow in FIG. 2.

The copying operation of the above copying machine is as follows:

The photosensitive drum 2 is charged with a selected polarity charge by the corona discharger 3. Then, the photosensitive drum is imagewise exposed to the reflected light from the original on the original table 9 illuminated by the lamp 10. The image-wise exposure is performed through the short focal point optical element array 4. By this image-wise exposure there is formed an electrostatic latent image on the drum surface. The latent image is then developed by the developing device 5 and the developed image is transferred onto a transfer material under the action of the transfer corona discharger 6. After transferring, the transfer material passes through the fixing device and is then discharged from the machine into the copy tray 18.

On the other hand, after transferring, the photosensitive drum 2 enters the cleaning station where the remaining toner on the drum surface is cleaned off by the cleaning device 7. Thus, the photosensitive drum is prepared for the next cycle of operation.

Figure 3B:
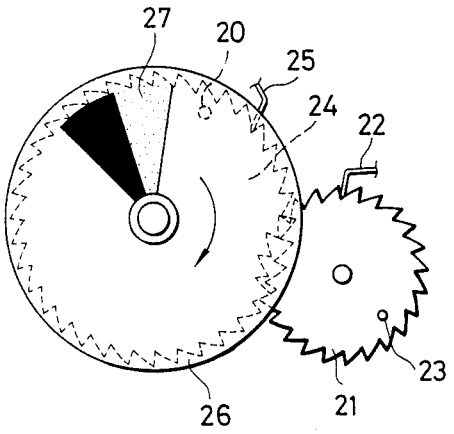
FIGS. 3A and 3B show the measuring mechanism provided on the process kit side in side view and in front view respectively.
Figure 3A:
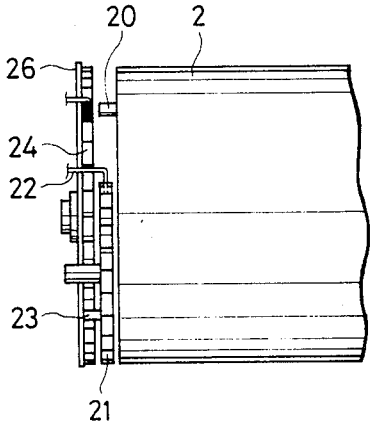

FIG. 3 illustrates the principle of the service life measuring mechanism provided in the process kit for counting the number of times the image forming operation is executed. FIG. 3A is a side view thereof and FIG. 3B is a front view of the same. In both FIGS. 3A and 3B, the casing covering the kit is removed for the purpose of illustration.

As shown in FIGS. 3A and 3B, the photosensitive drum 2 has a pin 20 projecting from the side surface of the drum. With one revolution of the drum 2, the pin 20 moves a ratchet 21 one tooth step. The ratchet 21 moved one tooth step is controlled by a leaf spring 22 in respect of the direction and amount of rotation. 23 is a pin projecting from the ratchet 21. With one revolution of the ratchet 21, a second ratchet 24 is moved one tooth step by means of the pin 23. Like the ratchet 21, the direction and amount of rotation of this second ratchet 24 is controlled by a leaf spring 25. In this manner, the ratchet 24 rotates step by step in the direction of the arrow in FIG. 3B. Fixed to the ratchet 24 is a disc 26 serving as a service life display part. The disc 26 has a colored radial zone 27 the area of which is determined by the useful life of the photosensitive drum 2. In a preferred embodiment of the service life display part, the area corresponding to the end of the useful life is colored in red paint and the area before the end of the service life is colored in yellow.

Figure 4:
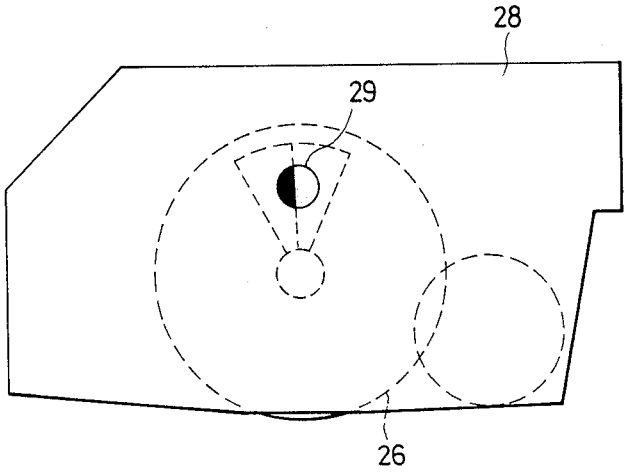
FIG. 4 is an illustration of the display part visible through the kit cover.

FIG. 4 schematically shows the process kit in the position after being mounted into the main body of the copying machine.

28 is a side cover plate of the process kit. The cover plate 28 has an opening 29 through which the user can directly observe the colored zone 27 of the disc on the ratchet 24 shown in FIG. 3. To this end, the front cover 19 of the main body also has an opening 19*a* (FIG. 2) in alignment with the opening 29 on the process kit's cover plate 28. Therefore, the user can observe the state of service of the process kit at any time.

In the above embodiment, the service life measuring mechanism has been formed as a counter mechanism which counts the number of times of executed image formation which is in turn obtained from the number of rotations of the photosensitive drum. By suitably setting the number of teeth of the ratchet mechanism any number of image formation times can be selected and displayed as the limit of service life of the process kit. However, it is to be understood that the counting mechanism used in the invention is never limited to the shown ratchet mechanism only. Other various methods may be used to count the number the times of image formation is executed. As an example, there may be used a cord which is taken up around the shaft of the photosensitive drum. Information of the number of times of image formation is obtained by counting the amount of the cord taken up around the drum shaft. It is not always necessary to obtain the number of times of image formation from the number of rotations of the drum. For example, it can be obtained also by detecting the amount of developing agent remaining in the developing device. In this case, the detected amount may be transformed into an electric value for lamp display of the end of the service life of the process kit in use. Further, information concerning the number of image formations may be obtained by counting the number of transfer sheets passed through the process kit.

Also, as to the form of display there may be used various display forms other than the above mentioned display by colored zone or lamp. For example, digital display may be used by providing a counter on the process kit. In this case, the switch part of the digital counter may be driven by making use of such force derived from any rotating member such as the photosensitive drum, sleeve or magnetic roller of the developing device or from the moving force of the transfer material passing through the process kit.

Figure 5:
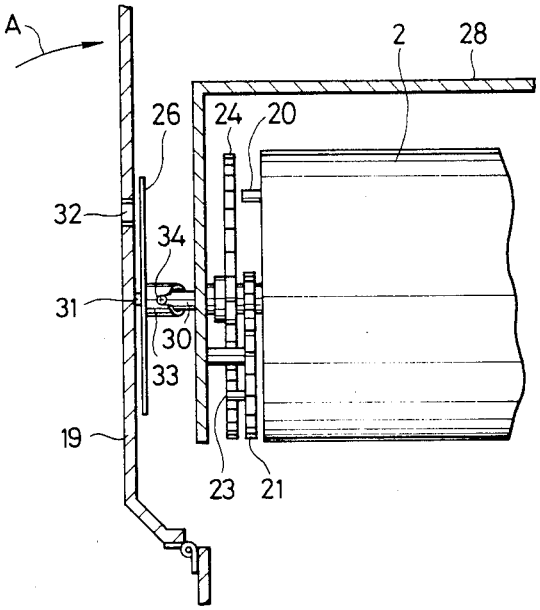
FIG. 5 shows another arrangement of the measuring mechanism according to the invention.

In the above embodiment, both the mechanical counting mechanism and the display mechanism have been provided on the process kit side. However, it is also possible in the instant invention to provide a display mechanism on the main body side while only the counting mechanism is provided on the process kit side. In case of such embodiment, the display mechanism becomes useful in relation to all the process kits exchanged in the same machine body. FIG. 5 illustrates such an embodiment.

In FIG. 5, again 2 is a photosensitive drum, 21 and 24 are ratchets, 20 is a pin and 28 is a casing covering the process kit. The structure of the counting mechanism contained in the process kit is essentially the same as that shown in FIG. 3. But, in this embodiment, the ratchet 24 has an output shaft 30 for putting out the counted amount. The output shaft 30 extends toward the front cover member 19 of the main body in which the process kit has been mounted. The cover member 19 has a shaft 31 projecting from the cover toward the output shaft 30. A service life display disc 26 as described above is rotatably mounted on the shaft 31 and can be observed through an opening 32 provided in the cover member 19. The disc 26 has a stud 33 engageable with a pin 34 on the shaft 30.

When the front cover 19 is closed in the direction of arrow A after inserting the process kit into the main body, the pin 34 on the output shaft 30 of the kit is engaged in a recess formed in the stud 33 on the display disc 26. Through this engagement, the disc is rotated with the output shaft 30 to display the number of times of use of the kit. After exchanging the used process kit for a new one, the kit pin on the new process kit is engaged in the recess of the stud 33 in the same manner as above. Thus, the display disc 26 is again rotated with the output shaft 30 of the new process kit to display the number of times of use of the kit.

Since the display part is provided on the main body side, this embodiment has an advantage over the first embodiment shown in FIG. 3 in that the display part can be used repeatedly for every process kit even after the used process kit has been disposed of. This makes it possible to reduce the cost required for the process kit as compared with the process kit shown in FIG. 3.

As a modification of the above embodiment, means for transforming the counted operations of service of the kit into an electric signal may be provided to the counting mechanism on the process kit side. In this case, the counting mechanism on the kit side is electrically connected to the display part on the main body side when the process kit is mounted into the main body. The display part may be formed of an LED element or counter.

An embodiment of the electrical service life measuring mechanism will be described hereinafter with reference to FIG. 6.

Figure 6:
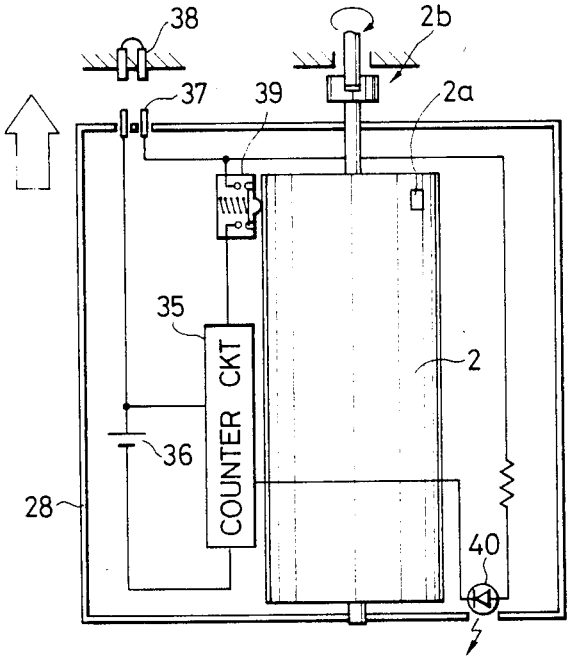
FIGS. 6 and 7 show still a further embodiment of the measuring mechanism.

FIG. 6 schematically shows the arrangement of a process kit and service life measuring mechanism according to the invention.

Like the above embodiments, the photosensitive drum 2 is contained in the kit cover 28. At the time of mounting, the drum is operationally connected to the main body of the copying machine through driving power transmission means *2b*. Although not shown, the same image forming means as shown in FIG. 1 are arranged around the drum. In this embodiment, the service life measuring mechanism includes a counter circuit 35 and an electric power source 36 are contained within the kit cover 18. The kit cover 28 is made of an electrically insulating material and has a terminal 37 partly projecting outward from the cover. When the kit is mounted into the main body, the terminal 37 is plugged into a switch plug 38 provided on the main body side and the power source 36 is connected to a counter switch 39. Thus, the circuit including the switch 39 and the counter circuit 35 is closed through the terminal 37. The number of revolutions of the photosensitive drum is added by ON-OFF of the switch 39 which is turned ON by a projection *2a* provided on the circumference of the drum 2. As switching means for the counter there may be used an electronic switch such as a photo coupler element in place of the mechanically actuated switch 39.

In the above embodiment, current is always supplied to the counter circuit 35 from the power source 36 irrespective of whether or not the process kit is present in the main body. Therefore, the content of the counter is not erased but kept in memory. The counter circuit 35 is connected to a display LED element 40 which is lighted on or flickered, for example, when the added count number is over a predetermined value. This gives a warning that the process kit comes close to the end of its service life. The display LED element 40 is positioned behind an opening in the kit cover 28 as shown in FIG. 6 so that the user can observe the display lamp through the opening from the outside of the casing 28. As previously noted, the front cover plate 19 of the main body has also an opening through which the user can directly observe the display lamp. Two LED elements different each other in hue of light may be used to indicate two different states of service life of the process kit, for example, one for indicating that the end of service life is near and the other for indicating that the service life has expired.

An advantage of the embodiment shown in FIG. 6 is found in that by using a battery as the power source in the process kit it is made possible to measure the useful age of the kit depending on the decaying of the battery with time. It is no longer necesassry to measure the remaining service life depending on the rotation of the photosensitive drum. As toner and the photosensitive layer in the kit are subjected to aging, a certain time length may be determined for the process kit as the service life thereof. In this case, when that time has passed, it is considered as the end of service life of the kit and it is displayed by the display element in the circuit.

Figure 7:
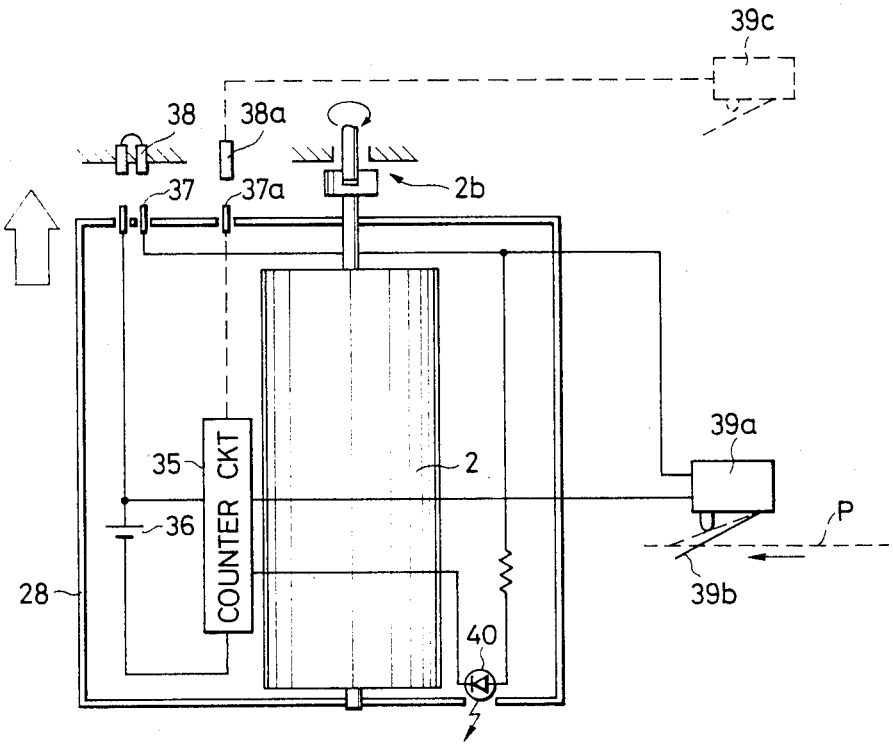

FIG. 7 shows a further embodiment of the invention.

In the embodiment shown in FIG. 6, the number of rotations of the photosensitive drum 2 has been measured by the counter switch 39. In contrast, in this embodiment shown in FIG. 7, the switch 39 is replaced by a microswitch 39*a* and the passage of transfer sheet P through the process kit is detected to count the number of transfer sheets passed through. In this manner, the amount of service of the process kit is measured by counting the number of transfer sheets passed through the kit. The switching member of the counter is not limited to a microswitch only. Other detection means such as a photo coupler element having light emission and light reception parts or an ultrasonic detection element may be used.

Figure 8:
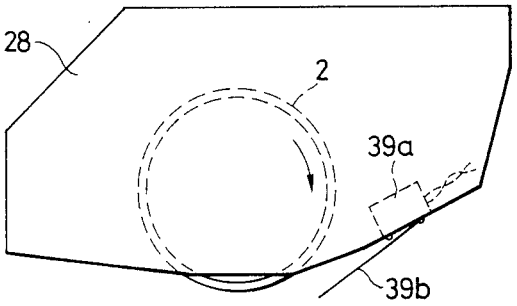
FIG. 8 is a side view of the process kit provided with the measuring mechanism shown in FIG. 7.

The mounting position of the above microswitch 39*a* on the process kit is shown in FIG. 8 wherein the switch 39*a* is disposed with its detection bar 39*b* extending in the direction along the passage of transfer material. The switch may be located at the upstream side or downstream side of the transfer station. It is also possible to provide the switch on the main body side as suggested in phantom at 39*c* in FIG. 7. In this case, the switch 39*c* on the main body side and the counter circuit 35 on the process kit side are connected to each other through the connection between plug 38*a* on the main body and terminal 37*a* on the kit at the time of mounting of the kit into the main body. As another modification of the embodiment the passing of transfer material may be indicated on the main body side and the signal may be transmitted directly to the counter circuit 35.

In the above embodiment, the passing of transfer material has been detected electrically. However, the detection can also be carried out mechanically. An embodiment of such mechanical detection will be described with reference to FIG. 9.

Figure 9:
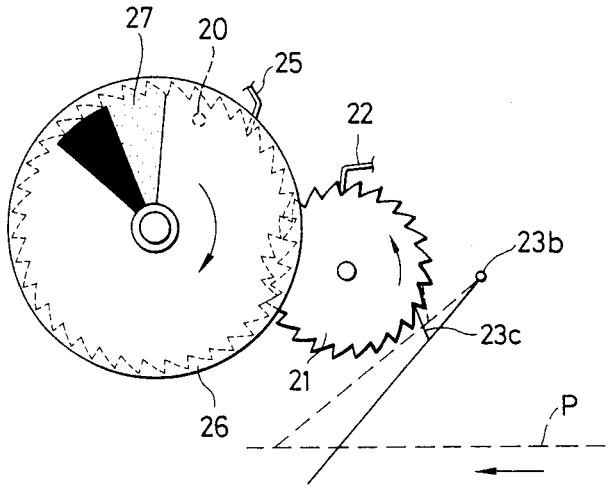
FIG. 9 is a side view of a further embodiment of the measuring mechanism.

The ratchet mechanism shown in FIG. 9 is essentially the same as that shown in FIG. 3B. In this embodiment, the ratchet 21 of the mechanism is driven by a swing arm 23*a* which is in turn swing moved by the movement of the transfer material P. The swing arm 23*a* is disposed to swing about a pin 23*a* and has a pawl 23*c* in engagement with the ratchet 21. Thus, the ratchet 21 is stepwise rotated by the pawl 23*c* at every passage of the transfer material P.

These embodiments in which the passage of transfer material is detected to measure the amount of use of the process kit, have a particular advantage in that the amount can be measured more correctly than by the embodiments shown in FIGS. 3 to 6. The reason for this is that the consumables in the process kit are necessarily consumed every time a transfer sheet passes through the kit. This will be readily understood considering, for example, the photosensitive drum. The photosensitive drum is sometimes rotated independently of image formation. For example, it is rotated solely for the purpose of cleaning, synchronization with other members etc. According to the embodiments shown in FIGS. 3 to 6, such rotations of the drum also will be counted as actual use of the process kit although the consumables have not been substantially consumed by it. The measuring method depending on the passage of transfer material as described above does not involve such problem. Furthermore, during the step of pre-rotation or post-rotation, the photosensitive drum is rotated only to make the potential on the drum surface uniform and constant. During the step, the photosensitive layer is less exposed to corona or light than at the step of image formation. Therefore, the photosensitive drum is less deteriorated by such pre-rotation and post-rotation than in the image formation. However, according to the embodiments shown in FIGS. 3 to 6, such pre-rotation and post-rotation also will be counted as in the number of services of the process kit for image formation although the drum and toner are not consumed in practice. In this connection one may think that such problem can be solved by presetting the number of rotations related to the service life of the photosensitive drum, taking into account the number of pre-rotations or post-rotations, because the image formation is inevitably attended by such pre-rotation or post-rotation. However, in case that a plural number of copies are made continuously from the same original, the number of pre- or post-rotations of the drum is not equal to the number of rotations for image formation. For these reasons, the measuring method depending on the passage of transfer material has an advantage over the measuring method depending on the rotation of the photosensitive drum in measuring the remaining useful life of the process kit according to the invention.

Figure 10:
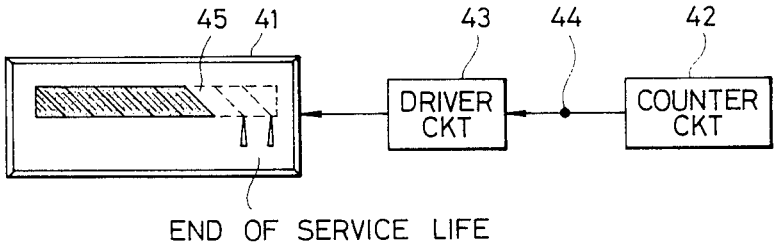
FIG. 10 is a block diagram of the electric circuit of the display part shown in FIG. 6 or 7.

FIG. 10 is a block diagram of electric circuit useful for the embodiment shown in FIG. 6 or 7.

41 is a service life display part provided on the main body side. 42 is a counter circuit for actually measuring the useful life of the process kit. The counter circuit 42 has the same structure as that shown in FIG. 6 and is provided on the process kit side. 43 is a display driving circuit provided on the main body side. Between the circuits 42 and 43 there is provided an electric connector 44. The connection of the counter circuit 42 and the display driving circuit 43 through the connector 44 may be attained making use of the motion for mounting the process kit into the main body or for closing the front cover member of the main apparatus. As previously mentioned with reference to FIG. 5, this arrangement has an advantage that the display part on the main body can be used repeatedly for every exchanged kit. In the shown embodiment, the measured value added by the counter circuit 42 is displayed on the dispaly part 41 every 200 counts. When the block 45 of the display part 41 is lighted ON, it gives the user a warning that the end of service life is near.

AS will be understood from the foregoing, the present invention brings forth many advantages over the prior art.

Since the process kit includes a mechanism for counting the number of times of image formation, the user can know the state of executed service of the process unit now independently of the amount of use of the main body. The user can prepare a new process kit for exchange prior to the expiry of the process unit then in use. Also, when the supplier has guaranteed the number of times of image formation by the process kit, the counting mechanism provided on the process kit side according to the invention gives a reliable data of the amount of use thereof to both the supplier and the user. Therefore, the data can be used also for confirmation of the term of guarantee.

While the present invention has been particularly shown and described in connection with a copying machine, it is to be understood that the application of the process kit of the invention is not limited to a copying machine only. As another application of the process kit of the present invention, mention may be made of, for example, output of facsimile equipment or computer. In such application form, there may be provided signal electrodes as latent image forming means in place of a corona charger and an optical system in the above embodiments. Also, the photosensitive drum may be replaced by an insulating drum.

What is claimed is:

1. A process kit receivable into an image forming apparatus, comprising:

process means provided in said process kit, said process means comprising an image bearing member and means actable thereon for repetitive image formation, supporting means for supporting said process means as a unit, counting means for detecting and counting the number of operations of the process kit and memorizing information relating to the amount of use;

a battery having a property of attenuating with time, and the attenuation being used for providing information as to the end of the service life of the process kit that is caused by the deterioration of the process kit over a period of time.

2. An image forming apparatus, comprising:

a process kit including process means provided in said process kit, said process means comprising an image bearing member and means actable thereon for repetitive image formation, and supporting means for supporting said process means as a unit, and means for memorizing an amount of use of said process kit;

a main assembly for cooperating with said process kit to form an image, said main assembly including means for forming a space for receiving said process kit and a guide for mounting said process kit into said main assembly and demounting said process kit from said main assembly; and means for providing information relating to the amount of use of said process kit in accordance with the content of said memory means.

3. An image forming apparatus, comprising:

a process kit including, as a unit, an image bearing member, means actable thereon and disposed around said image bearing member, means for integrally supporting said image bearing member and said actable means, means for receiving a driving force, means for memorizing the amount of use of said process kit, means for displaying the amount of use of said process kit relating to the content of said memory means; and a main assembly into which said process kit is mountable and from which it is demountable, said main assembly including means for forming a space for receiving said process kit and means, engageable with said driving force receiving means, for transmitting driving force to said driving force receiving means.

4. An apparatus according to claim 3, wherein said display means displays through an opening of a cover of said main assembly to allow observation from outside.

5. An apparatus according to claim 3, wherein said memory means is operable in response to rotational movement of said image bearing member, the amount of which is memorized as the amount of operations of said process kit.

6. An apparatus according to claim 5, wherein said display means is supported integrally with said memory means of said process kit and includes a member rotatable with said image bearing member.

7. An image forming apparatus, comprising:

a process kit including as a unit an image bearing member, means actable thereon and disposed around said image bearing member, means for integrally supporting said image bearing member and said actable means, means for receiving a driving force, means for memorizing an amount of use of said process kit; and a main assembly into which said process kit is mountable and from which it is demountable, said main assembly including means for forming a space for receiving said process kit, means, engageable with said driving force receiving means, for transmitting driving force to said driving force receiving means and means cooperable with said memory means to display information relating to the content of said memory means.

8. An apparatus according to claim 7, wherein said display means displays through an opening of a cover of said main assembly to allow observation from outside.

9. An apparatus according to claim 7, wherein said memory means is operable in response to rotational movement of said image bearing member, the amount of which is stored as the amount of operations of said process kit.

10. An image forming apparatus comprising:

a process kit including as a unit an image bearing member, means actable thereon and disposed around said image bearing member, means for integrally supporting said image bearing member and said actable means, means for receiving a driving force, means for memorizing an amount of use of said process kit;

a main assembly into which said process kit is mountable and from which it is demountable, said main assembly including means for forming a space for receiving said process kit, means, engageable with said driving force receiving means, for transmitting driving force to said driving force receiving means and means cooperable with said memory means to display information relating to the content of said memory means, and wherein said memory means is operable by in response to rotational movement of said image bearing member the amount of which is stored as the amount of operations of said process kit, wherein said display means is supported integrally with said memory means of said process kit and includes a member rotatable with said image bearing member.

11. An image forming apparatus, comprising:

a process kit including process means provided in said process kit, said process means comprising an image bearing member and means actable thereon for repetitive image formation, supporting means for supporting said process means as a unit, and means for memorizing an amount of use of said process kit;

a main assembly for cooperating with said process kit to form an image, said main assembly including means for forming a space for receiving said process kit and a guide for mounting said process kit into said main assembly and demounting said process kit from said main assembly;

switching means operable between on and off positions in response to image forming operations; and display means for displaying information relating to the amount of use of said process kit in accordance with the content of said memory means.

12. An apparatus according to claim 11, wherein said switching means is provided in said process kit.

13. An apparatus according to claim 11, wherein said switching means is provided in said main assembly, said process kit further including means for connecting said memory means and said switching means.

14. A process kit mountable into and demountable from a main assembly comprising as a unit:

an image bearing member;

means actable thereon and disposed around said image bearing member;

means for integrally supporting said image bearing member and said actable means;

means adapted to receive a driving force from the main assembly;

means for memorizing the amount of use of said process kit; and means cooperable with the main assembly to provide information relating to the control of said memory means.

15. A process kit according to claim 14, wherein said process means includes a photosensitive member, a charger, a developing device, and cleaning means.

16. A process kit according to claim 15, wherein said memory means converts movement of said photosensitive member to rotation of a rotatable member, and displacement of said rotatable member is memorized as the amount of operations of said process kit, and wherein said display means is supported integrally with said memory means and rotates in accordance with rotation of said rotatable member.

17. A process kit mountable into and demountable from a main assembly, comprising as a unit:

an image bearing member;

means actable thereon and disposed around said image bearing member;

means for integrally supporting said image bearing member and said actable means;

means adapted to receive a driving force from the main assembly;

means for memorizing the amount of use of said process kit; and means cooperable with the main assembly to provide information relating to the content of said memory means.

18. An apparatus according to any one of claims 2, 3, 7 or 11, wherein said memory means is effective to store a quantity of material to be consumed during image forming operations using said process unit.

19. An apparatus according to claim 18, wherein said material is image transfer material on which images are formed using said process unit.

20. A process unit according to claim 18, wherein said material is image transfer material on which images are formed using said process unit.

21. A process unit according to claim 14 or 17, wherein said memory means is effective to store a quantity of material to be consumed during image forming operations using said process unit.

* * * * *

UNITED STATES PATENT AND TRADEMARK OFFICE

CERTIFICATE OF CORRECTION

PATENT NO. : 4,551,000

DATED : November 5, 1985

INVENTOR(S) : SHINJI KANEMITSU, ET AL.

It is certified that error appears in the above-identified patent and that said Letters Patent is hereby corrected as shown below:

COLUMN 1, line 31, "in case of" should read --in the case of a--.

COLUMN 2, line 60, "gaurantee" should read --guarantee--.

COLUMN 3, line 12, "." should read --;--.

COLUMN 4, line 65, "the times of" should read --of times the--.

COLUMN 6, line 22, after "36" insert --which--;
line 54, after "different" insert --from--.
line 63, "necesassry" should read --necessary--.

COLUMN 7, line 49, after "embodiments" insert --,--.

COLUMN 8, line 44, "dispaly" should read --display--.
line 48, "AS will" should read --As will--.

Signed and Sealed this

First Day of July 1986

[SEAL]

Attest:

DONALD J. QUIGG

Attesting Officer

Commissioner of Patents and Trademarks